United States Patent [19]

Raasch et al.

[11] 4,120,462

[45] Oct. 17, 1978

[54] METHOD AND DEVICE FOR CONTROLLING AND/OR REGULATING THREAD TENSION DURING WINDING OF A TEXTILE COIL

[75] Inventors: Hans Raasch; Hans Ludwig Neuhaus, both of Monchen-Gladbach, Germany

[73] Assignee: W. Schlafhorst & Co., Monchen-Gladbach, Germany

[21] Appl. No.: 671,113

[22] Filed: Mar. 29, 1976

[30] Foreign Application Priority Data

Mar. 29, 1975 [DE] Fed. Rep. of Germany ..... 2513981

[51] Int. Cl.[2] ..... B65H 59/38; B65H 54/42; B65H 54/52

[52] U.S. Cl. ..... 242/45; 242/18 DD; 242/18.1

[58] Field of Search ..... 242/45, 18 DD, 18.1

[56] References Cited

U.S. PATENT DOCUMENTS

| | | | |
|---|---|---|---|
| 1,353,474 | 9/1920 | Holt et al. | 242/18 DD |
| 1,915,241 | 6/1933 | Reece | 242/18.1 |
| 2,524,121 | 10/1950 | Crouzet | 242/18 DD |
| 2,747,805 | 5/1956 | Schweiter et al. | 242/18 DD |
| 3,743,202 | 7/1973 | Hoffsommer et al. | 242/45 |

FOREIGN PATENT DOCUMENTS

| | | | |
|---|---|---|---|
| 920,054 | 11/1954 | Fed. Rep. of Germany | 242/18 DD |
| 53,333 | 1/1945 | France | 242/18 DD |
| 1,243,940 | 9/1960 | France | 242/18 DD |
| 496,959 | 12/1938 | United Kingdom | 242/18 DD |
| 782,917 | 9/1957 | United Kingdom | 242/18 DD |
| 872,608 | 7/1961 | United Kingdom | 242/18.1 |

*Primary Examiner*—Stanley N. Gilreath
*Attorney, Agent, or Firm*—Herbert L. Lerner

[57] ABSTRACT

Method of controlling or regulating tension in a thread being wound on a textile coil rolling on a winding roller of a thread-winding device, which includes varying the peripheral speed of the textile coil by varying the transmission ratio between the rotary speed of the winding roller and the rotary speed of the textile coil to an extent greater than the variation in the transmission ratio therebetween resulting from the increasing fullness of the winding on the coil.

14 Claims, 7 Drawing Figures

FIG. 5
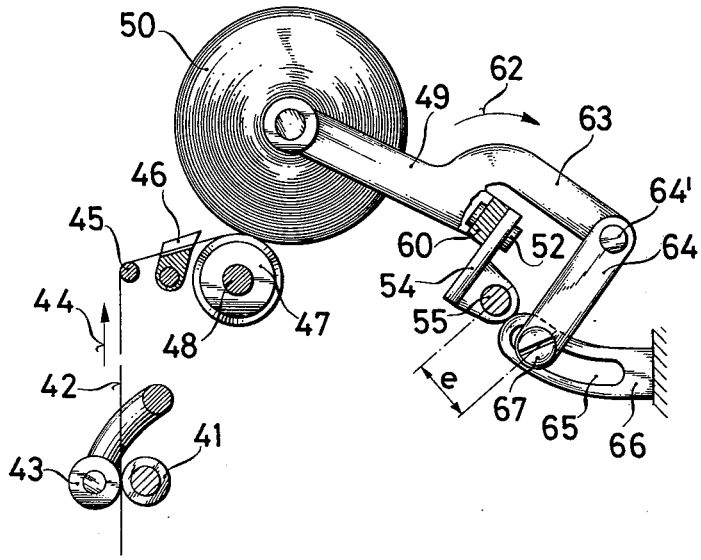
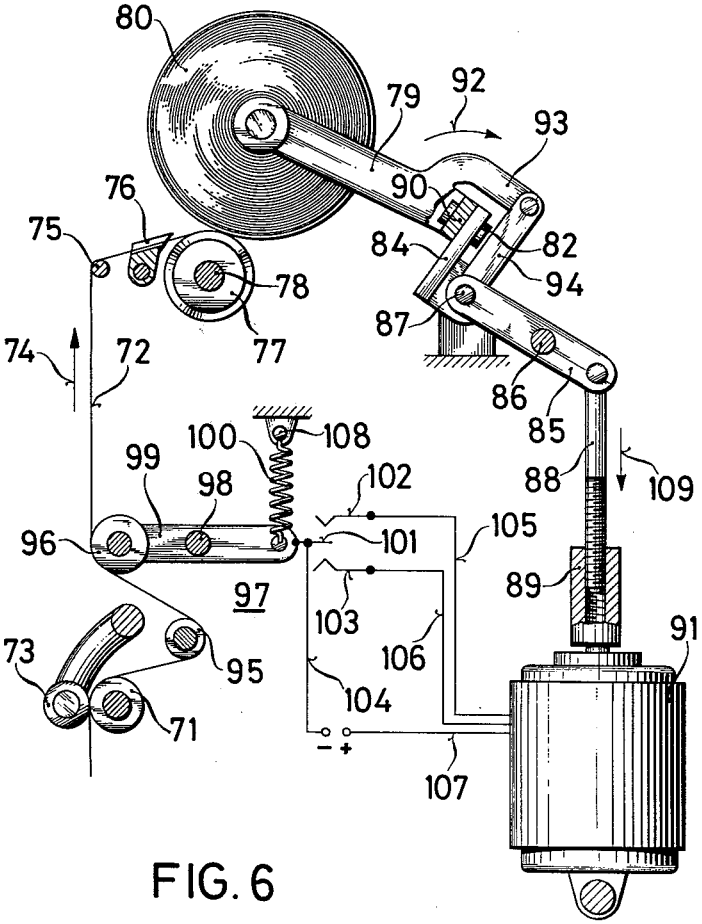
FIG. 6
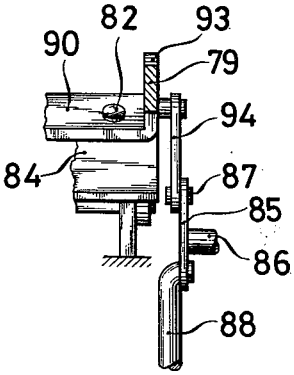
FIG. 4

METHOD AND DEVICE FOR CONTROLLING AND/OR REGULATING THREAD TENSION DURING WINDING OF A TEXTILE COIL

The invention relates to a method and device for controlling and/or regulating the thread tension in the winding of a textile coil rolling on a winding roller of a winding device.

In the winding of textile coils, particularly of cross-wound bobbins or cheeses having random winding, wherein the thread is supplied at constant velocity, thread tension is produced due to the fact that the winding drum or roller drives the textile coil being wound with a slightly higher winding speed than the feeding speed of the thread supplying device. The thread is thereby stretched and the tension in the thread adjusts itself in accordance with the elongation or the extent to which the thread has been stretched. In order to avoid difficulties in the further processing of the textile coil, the thread tension should remain constant. Although minor, short-term fluctuations of the thread tension may occur during the stroke of the thread guide, those fluctuations are generally harmless because they balance out as a mean or average tension, and only the mean thread tension need be kept constant.

In practice, a previously adjusted thread tension does not remain constant with respect to the mean value thereof. One reason for this was recognized to be the fact that, with increasing fullness or diameter of the coil, the coil width i.e. the axial dimension of the coil, decreases, because the thread has a tendency to drop back more and more toward the center of the coil at the outer reversing points thereof. This decrease in the coil width i.e. axial dimension, with increasing fullness of the coil may be entirely desirable, as it simultaneously softens the edges of the coil and minimizes the danger of threads being sloughed off.

Heretofore, variations in thread tension due to a decrease in the coil width i.e. axial dimension, with increasing coil fullness has been considered a drawback, although it is for this reason especially that a limitation of the maximally possible coil diameter occurs in textile coils that are very softly adjusted.

It is accordingly an object of the invention to provide such a method and device in accordance with the invention which adjusts and maintains the thread tension so that textile coils which have a very soft adjustment can also be produced in large sizes, the density of the textile coil varying only within narrow and therefore, permissible limits.

With the foregoing and other objects in view, there is provided, in accordance with the invention, a method of controlling or regulating tension in a thread being wound on a winding roller of a thread-winding device, which comprises varying the peripheral speed of the textile coil by varying the transmission ratio between the rotary speed of the winding roller and the rotary speed of the textile coil to an extent greater than the variation in the transmission ratio therebetween resulting from the increasing fullness of the winding on the coil; preferably, the peripheral speed of the textile coil is varied continuously. Accordingly, an increase in the peripheral speed of the textile coil results in greater thread tension, whereas a decrease in the peripheral speed thereof produces lower thread tension. The transmission ratio is therefore preferably made variable in both directions i.e. in increasing and in decreasing directions.

In accordance with another feature of the invention, the variation in the peripheral speed of the textile coil is dependent upon at least one of the parameters: fullness of the coil winding as measured by the coil diameter and/or the measured thread tension.

In accordance with a further feature of the invention, the peripheral speed of the textile coil is varied by varying, preferably continuously, the contact pressure of the textile coil on the winding roller and accordingly forcibly varying slippage of the textile coil relative to the winding roller. This occurs also in addition to the previously existing variation in the slippage due to the increasing fullness of the bobbin.

In accordance with an added feature of the invention, wherein either the winding roller or the textile coil is of conical construction the method includes tipping either the winding roller or the textile coil relative to the other so as to increase the compressive force of the textile coil on the winding roller toward one or the other end of the line of contact therebetween. If the winding roller is conical and the textile coil cylindrical, of if the latter is conical with the taper thereof decreasing in a direction opposite that for the conical textile coil, the peripheral speed of the textile coil becomes larger if the contact pressure is increased toward the larger end of the cone. If, on the other hand, the winding roller is cylindrical and the textile coil conical, the peripheral speed becomes smaller in such case. The drive zone is always displaced to the location at which the greater contact pressure prevails.

In accordance with an additional feature of the invention, the winding roller is made conical with the result that the transmission ratio is thereby variable in a relatively simple manner by tilting or tipping the textile coil toward the one or the other end of the contact line between the textile coil and the winding roller both when the textile coils are cylindrical as well as conical.

In accordance with a further feature of the invention, subsequent to ascertaining that the thread tension is relaxed with increasing coil fullness, the extent to which the textile coil or the winding roller is tipped relative to the other is made dependent upon the parameter; fullness of the coil winding or the coil diameter, which is a measure thereof.

In accordance with yet another feature of the invention wherein the variation in the peripheral speed of the textile coil is dependent upon the measured thread tension, the method includes automatically and continuously sensing the thread tension and increasing the contact pressure between the textile coil and the winding roller at the one end of the line of contact therebetween at either the larger-diameter or smaller-diameter end of the cone in accordance with the sensed variation in the thread tension.

Both of the foregoing control or regulation features may also be combined one with the other. Thus, in accordance with yet a further feature of the invention, the method comprises tipping either the winding roller or the textile coil relative to one another to an extent, either a bit greater or a bit less, than is required by the increasing coil fullness as measured by the increasing coil diameter so that the actual thread tension continuously resulting therefrom is correspondingly different i.e. slightly too large or slightly too small, all other conditions being equal, from the value thereof that would result from the extent of tipping of either the winding roller or the textile coil relative to one another as required by the value of the respective parameter, and controllingly readjusting only in one direction of successive values thereof i.e. increasingly or decreasingly, the thus differing thread tension to a nominal value thereof in accordance with the actual thread tension value.

In accordance with the device of the invention for implementing the method of the invention, there are provided coil frame means for holding a textile coil, a rotatable winding roller contactable with the textile coil for applying frictional pressure thereto, preferably continuously, for varying the contact pressure between the textile coil and the winding roller. The variation in the contact pressure may be either variation in the intensity of the pressure as well as variation in the location of the pressure zone i.e. the area at which the pressure is applied.

In accordance with another feature of the device of the invention, there are provided pressure-varying means associated with either the winding roller or coil frame means or both thereof for continuously varying the contact pressure between the textile coil and the winding roller, and means for determining either the fullness of the coil as a measure of the diameter thereof or the thread tension, the respective determining means being operatively associated with the pressure varying means for controlling the same in accordance with the tension in the thread.

The coil fullness is determinable, for example, also indirectly by determining the movement of the coil frame means. It is also sufficient to make the determination periodically and to retain or store the result of the determination in the setting or calibration of the means for varying the contact pressure.

In pursuing this idea further, either the winding roller or the textile coil, is conical or, both are conical, with the conicity thereof extending in opposite direction, either the axis of the textile coil or the axis of the winding roller being disposed so as to be tiltable or tippable in direction toward the line of contact between the textile coil and the winding roller.

In accordance with a further feature of the device of the invention, the coil frame means for holding the textile coil is tippable about an axis which extends transversely to the longitudinal axis of the coil core.

Control of the thread tension in accordance with the fullness of the coil can be programmed beforehand very well; the control program being capable of being carried out in dependence upon the deflection of the coil frame means.

In accordance with an added feature of the device of the invention, control means are provided which are responsive to the fullness of the coil as measured by the coil diameter for tipping the axis of either the coil frame means or the textile coil, the control means comprising, for example, a control cam or a kinematic four-bar linkage.

In accordance with an additional feature of the device, the slope or steepness of the control cam or the articulating or pivot point of the four-bar kinematic linkage is variable so as to afford manual adjustment of the extent of tipping or tilting of the textile coil or the coil frame means.

Since the thread tension depends also upon the slippage between the textile coil and the winding roller, and the slippage, in turn, depends upon the contact pressure of the textile coil, the hardness of the coil and the bearing friction, the control or regulation of the thread tension in accordance with the coil fullness or coil diameter alone is often insufficient so that, in accordance with another feature of the invention, there is provided means operatively associated with either the textile coil or the coil frame means for sensing the thread tension and for tilting or tipping the axis of the coil core in accordance with the thread tension.

The number of elements required for controlling or regulating is minimized when, in accordance with yet another feature of the invention, the means for tipping the axis of the coil core is equipped so as to control the thread tension only in one direction of successive values, preferably in the direction of reduction in the thread tension. This advantageous control in one direction is afforded, for example, in accordance with another feature of the invention, by providing means for producing a thread pretension which exceeds the nominal value thereof. This last-mentioned means can be integrated with the means for tilting or tipping the coil axis in dependence upon the coil fullness. Therefore, in accordance with a further feature of the invention, the means for tilting or tipping the coil axis in dependence upon the coil fullness or the coil diameter is disposed for controlling the thread tension in only one direction, preferably in the direction of increasing the thread tension beyond the reference or nominal value thereof.

When winding conical textile coils, it had previously become known to be advantageous to drive the coil, at a defined location, preferably substantially in the middle of the coil at least at the start of the winding process.

In the interest of having stable control or regulation, it is also advantageous; and in accordance with a concomitant feature of the invention, to provide such a zone of increased or heightened friction; preferably in the form of a circular ring; and to locate that zone in the case of conical winding rollers, preferably toward the smaller end of the cone, so that, starting from this initial drive zone toward the larger diameter end of the cone, as much latitude as possible is available for relocating the contact pressure. In the case of cylindrical winding rollers which serve to wind conical coils or bobbins, the zone of increased or heightened co-efficient of friction is, accordingly, preferably disposed toward the larger-diameter end of the cone.

The zone with the increased or heightened friction may consist, for example, of a zone that is elevated somewhat above the surface yet being otherwise similar to the rest of the surface, or it may be a zone having increased surface roughness. At the start of the winding of a textile coil, the latter is always driven within the limits of this zone of increased friction. Slippage between the textile coil and the winding roller thereby remains free of excessive fluctuations.

Advantages of the method and device of the invention are especially that the decrease of the thread tension caused by the increasing coil fullness can be compensated for or equalized by relatively simple control devices and, in addition, an adjustable thread tension can be kept constant within adjustable tolerance limits in a relatively simple manner by control devices acting on one or both sides.

Other features which are considered as characteristic for the invention are set forth in the appended claims.

Although the invention is illustrated and described herein as method and device for controlling and/or regulating thread tension during winding of a textile coil, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings, in which:

FIG. 4 is a front fragmentary view of FIG. 6;

FIGS. 5 and 6 are views similar to that of FIG. 1 of additional embodiments of the apparatus of the invention.

Figure 1:
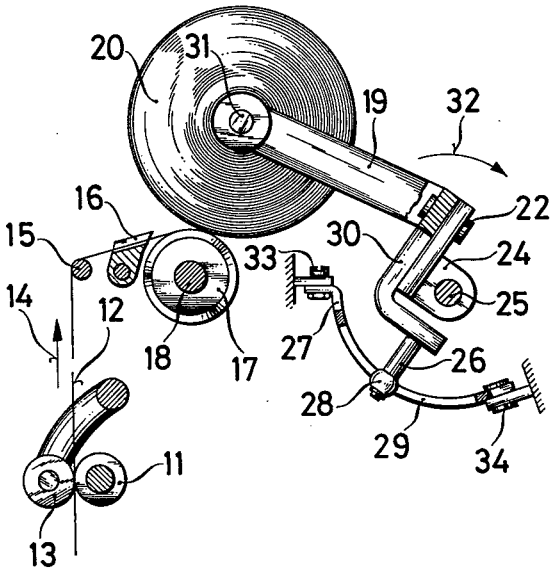
FIGS. 1 and 2 are diagrammatic side and front elevational views, respectively, of an apparatus for implementing the method according to the invention.
Figure 2:
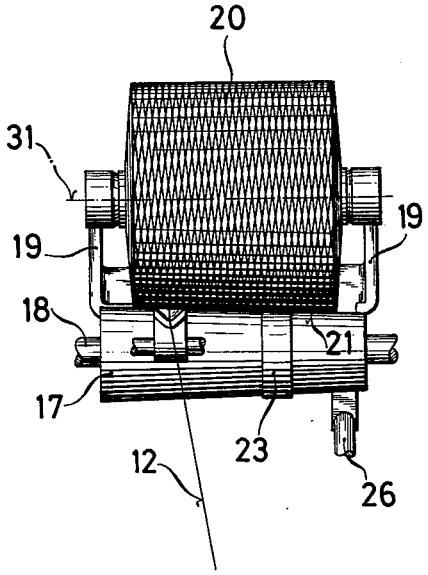

Referring now to the drawings and first, particularly, to FIGS. 1 and 2 thereof, a winding apparatus of an otherwise non-illustrated spinning or twisting machine is shown in a diagrammatic side elevational view in FIG. 1 and in a front elevational view in FIG. 2. The machine includes a driven take-up roller 11, which feeds a thread 12 by means of a pressure roller 13 in direction of an arrow 14 over a deflecting or guide bar 15 and a reciprocating or traversing thread guide 16 to a winding drum or roller 17 fastened on a shaft 18 and rotating at constant speed.

A cylindrical textile coil or bobbin 20 held by a coil or bobbin frame 19 rolls on the winding drum 17 and is set in rotation by the winding drum 17 through friction. The thread 12, accordingly, runs up onto the textile coil or bobbin 20 continuously at the contact line 21.

The winding drum 17 is of conical shape and has a circular ring-shaped zone 23 of increased friction which is disposed toward the smaller end of the cone.

Figure 3:
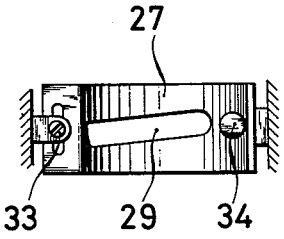
FIG. 3 is a fragmentary top plan view of FIG. 1 showing more explicitly a detail of this apparatus.

The coil or bobbin frame 19 is rotatably secured by a traverse shaft 22, located toward the smaller end of the conical winding drum 17, to a bearing plate 24, which is rotatable about a stationary shaft 25. These elements 19 and 22 in this embodiment form the fullness determining or measuring means by allowing the coil fullness to automatically tilt the frame 19 on the shaft 22. With increasing bobbin fullness, the bearing plate 24 and the bobbin frame 19, attached thereto, pivot about the shaft 25. An extension arm 30 of the bobbin frame 19 has a control pin 26 which is guided by a stationary control coulisse or slider block 27, which is shown in a top plan view in FIG. 3. The control pin 26 carries at the lower end thereof, a spherical roller 28 which is guided in a slot 29 formed in the control coulisse or slider block 27. The contour and position of the control slot 29 determines the position of the extension arm 30 and therewith also the position of the coil frame 19 and the inclination of the axis 31 of the textile coil 20, thus forming control means in the embodiment of FIGS. 1 - 3.

The control coulisse 27 is pivotable about a swivel joint 34 and is so disposed that it can be set or adjusted and locked by the set screw 33. The pressure varying means in the first embodiment, which includes the fullness determining means, consists of the coulisse 27, the pin 26, the arm 30 and the frame 19, and operates as follows:

The slot 29 of the control coulisse 27 is so disposed that, if the coil frame 19 is swung about the shaft 25 in the direction of the arrow 32 due to the increasing fullness of the coil 20, the axis 31 of the textile coil 20 is tilted in direction toward the larger-diameter end of the conical winding drum 17 and thereby, the contact pressure at the larger-diameter end of the cone is increased. The textile coil 20 is accordingly driven with a greater peripheral velocity. This tilting or tipping motion, necessary for equalizing the thread tension, is generally so slight that only an elastic deformation of the textile coil occurs, so that the edge of the coil does not, in fact, lift off or away from the smaller-diameter end of the conical winding drum.

A somewhat different embodiment of the invention is shown in simplified form in FIG. 5 in a side elevational view. Here, too, a take-up roller 41 is provided which again feeds a thread 42 by means of a pressure roller 43 in direction of the arrow 44 over a deflection or guide bar 45 and a reciprocating or traversing thread guide 46 to a winding drum 47, which is secured on a shaft 48 and rotates at constant speed.

A textile bobbin or coil 50 held by a bobbin or coil frame 49 rolls on the winding drum 47 and is set into rotation by the winding drum 47 through friction. The thread 42 accordingly continuously runs up onto the textile coil 50 at the line of contact therewith. The winding drum 47 again has a conical shape.

A cross bar 60 of the coil frame 49, in a manner similar to that in the embodiment of FIGS. 1 and 2, is rotatably fastened by a transverse shaft 52, to a bearing plate 54 which is rotatable about a stationary shaft 55. With increasing coil or bobbin fullness, the bearing plate 54 and, accordingly, also the bobbin or coil frame 49 turn about the shaft 55 in direction of the arrow 62, thus elements 49 and 52 constitute the fullness determining or measuring means in the embodiment of FIG. 5.

The bobbin frame 49 has an extension arm 63, to which a link 64 is articulatingly connected by means of a joint pin 64'. The link 64 is rotatable, at the lower end thereof as shown in FIG. 5, about a pin 67, which is adjustably fastened in the slot 65 of the stationary frame 66. The pressure varying means in the embodiment of FIG. 5 which is formed of the frame 66, link 64 and arm 63 of frame 49 operates as follows: As the distance from the axis of the stationary shaft 55 to the central axis of the pin 67 is increased to an adjustable distance e, the desired tilting or tipping of the coil frame 49 about the transverse shaft 52 occurs if the bobbin frame 49 is rotated in the direction of the arrow 62. This tilting or tipping of the coil frame 49 occurs with increasing coil fullness in the direction toward the larger-diameter end of the conical winding drum 47. Control of the tipping is accomplished through the movement of the pin 67 in the slot 65 of the frame 66 which forms control means in the embodiment.

In the embodiment of the invention according to FIG. 6, with details thereof shown in FIG. 4, the position of the contact zone between the textile coil 80 and the winding drum 77 is made dependent upon the measured thread tension.

As in the foregoing embodiments, that of FIG. 6 also has a takeup roller 71, which feeds a thread 72 by means of a pressure roller 73 in direction of the arrow 74 over a deflecting or guide bar 75 and a reciprocating or traversing thread guide 76 to a conical winding drum 77 which is fastened on a shaft 78 and rotated at constant speed.

The textile coil 80 held by a coil frame 79 rolls on the winding drum 77 and is frictionally driven thereby. The thread 72 accordingly runs continuously onto the textile coil 80. The winding drum 77 has a conical shape.

As in FIGS. 1 and 2, the embodiment of FIG. 6 has a cross bar 90 of the coil frame 79 which is rotatably connected by a transverse shaft 82 to a bearing plate 84, that is rotatable about a stationary shaft which is not visible in FIG. 6 because it is hidden by an articulating joint 87. With increasing coil fullness, the bearing plate 84 and, thereby, also the coil frame 79, rotates in direction of the arrow 92 about the hidden stationary shaft of the coil frame 79, thus forming fullness determining or measuring means.

The coil frame 79 has an extension arm 93, to which a strap 94 is articulatingly connected. The lower end of the strap 94, as viewed in FIG. 6, is connected by the joint 87 with a double-arm lever 85, which is pivotable about a stationary pin 86. The other end of the lever 85 is articulatingly linked to a threaded spindle 88, which is axially displaceable through the intermediary of a threaded nut 89 by a positioning motor or servomotor 91.

On its way from the take-up roller 71 to the deflecting or guide bar 75, the thread 72 is looped around a stationary roller 96 of a thread-tension sensor 97. The thread-tension sensor 97 is formed of a double-arm lever 99 pivotable about a stationary pivot shaft 98, one end of the lever 99 carrying the roller 96, and the other end thereof being loaded or biased by a tension spring 100. The lever 99 additionally carries a tongue-like contact member 101 which is disposed between two adjustable limit contacts 102 and 103 of a switch. From the negative pole of an otherwise non-illustrated d-c voltage source, a line 104 leads to the tongue-like contact member 101. From the limit contacts 102 and 103 and from a positive pole of the d-c voltage source, lines 105, 106 and 107 lead to the positioning motor or servomotor 91.

By varying the location of the suspension point 108, the tensile force of the tension spring 100 is adjustable. As is apparent, the tensile force of the spring 100 counteracts the thread tension which acts through the roller 96 on the lever 99. If the equilibrium between the thread tension and the biasing force of the spring 100 is disturbed, the tongue-like contact member 101 makes contact either with the limit contact 102 or the limit contact 103, so that the positioning motor 91 is energized to run either clockwise or counterclockwise. The pressure-varying means which, in the embodiment of FIGS. 4 and 6 is composed of the thread-tension sensor 97, servomotor 91, spindle 88, lever 85, strap 94 and member 93 of frame 79, operates as follows: The direction of rotation of the positioning motor 91 is so chosen that when the tension of the thread 72 is relaxed, the threaded spindle 88 is moved in the direction of the arrow 109 and the coil frame 79 is tilted or tipped, through the members 85, 94 and 93, about the transverse shaft 82 in direction toward the larger-diameter end of the conical winding drum 77. In the embodiment of FIGS. 4 and 6 the four bar kinematic linkage consisting of elements 84, 90 and 94 and the ground form control means responsive to the fullness of the coil. If the thread tension rises too high i.e. beyond a given tolerance, the coil frame 79 is tilted or tipped in the opposite direction. The fullness determining means consists of elements 79 and 82 in this embodiment, which are part of the pressure varying means. As long as the tongue-like contact member 101 engages neither of the limit contacts, i.e. within the adjusted tolerance range of the thread tension, no control or regulation of the peripheral velocity of the textile coil 80 is effected. Control of tipping is thus effected by the thread-tension sensor 97 and the servomotor 91, which form the control means in the embodiment of FIGS. 4 and 6.

A further embodiment of the invention will now be described with reference to FIG. 7 of the drawing. In the winding apparatus shown in simplified form in a side elevational view in FIG. 7, there is also a take-up roller 111, which feeds a thread 112 by means of a resiliently secured pressure roller 113 in direction of the arrow 114 over a deflecting or guide bar 115 and a reciprocating or traversing thread guide 116 to a conical drum 117, which is fastened on a shaft 118 and rotates at constant speed.

A textile coil 120 held by a coil frame 119 rolls on the conical winding drum 117 and is frictionally driven thereby. The thread 112 accordingly runs continuously onto the textile coil 120.

A cross bar or beam 121 of the coil frame 119 is articulatingly linked, as in the embodiment of FIGS. 1 and 2, through a joint pin 122 to a bearing plate 123 which is rotatable about a stationary shaft 124. With increasing coil fullness, the coil frame 119 with the bearing plate 123 fastened thereto swings about the shaft 124 in direction of the arrow 125. Thus the fullness determining or measuring means in the embodiment of FIG. 7 consists of the frame 119 and joint pin 122.

The coil frame 119 has an extension rod 126 to which a strap 127 is fastened by means of an articulating joint 127'. The lower end of the strap 127, as viewed in FIG. 7, is connected through an articulating joint 128 with an extension 129 of a ratchet wheel 130, which is rotatable about a stationary pin 131. A pawl 133 positively rotatable about a stationary pin 132 yieldably engages in a gap between the teeth of the ratchet wheel 130. A strong tension spring 134 loads the ratchet wheel 130 in such a manner that it cannot be moved, by the forces exerted by the coil frame 119, out of the position fixed by the pawl 133. The thread 112 is guided over a stationary roller 135 and is looped around a roller 136 of a thread-tension sensor 137, on the path of the thread 112 from the take-up roller 111 to the deflecting or guide bar 115. The thread tension sensor 137 has, in addition, a two-arm lever 139 which is pivotable about a stationary pivot shaft 138, one end thereof carrying the roller 136 and the other end thereof being loaded by a tension spring 140. Adjacent the end of the lever 139 at which the spring 140 is located, a one-arm lever 142 is suspended in pendulum-fashion, from a stationary pivot shaft 141. The lever 142 is articulatingly linked by a rod 143 to one end 144 of a bellcrank lever 146 pivotable about a stationary pivot shaft 145. An actuator rod 148 is articulatingly linked at one end thereof to the other end 147 of the bell crank lever 146 and is articulatingly linked at the other end thereof to one end of a two-arm lever 149 which is pivotable about a stationary pivot shaft 150. At the other end of the lever 149, a pawl 152 is constructed and articulatingly secured by means of a pin 151 in such a manner that an extension 153 thereof engages a stop 154. The instant the lever 149 is moved in direction of the arrow 155, the pawl 152 engages in a gap between respective teeth of the ratchet wheel 130. If the lever 149 is moved in the opposite direction, however, the pawl 152 can rotate freely about the pin 151 and slide out of the gap between the teeth of the ratched wheel 130.

To the end 147 of the bellcrank lever 146, there is further secured a pull rod 156 which is connected to a continuously swinging or oscillating lever 158 through the intermediary of a pretensioned compression spring 157. The lever 158 is pivotally attached at one end thereof to a stationary articulating joint 159 and is biased at the other end thereof by a tension spring 160 against an eccentric cam 161 of a continuously rotating eccentric shaft 162. The pressure varying means in the embodiment of FIG. 7 includes the tension mechanism 137 and the rod 156 working on the crank 146, the rod 148, lever 149, pawl 152, wheel 130, strap 127 and rod 126 of frame 119. The pressure varying means operates as follows:

Because spacing from the axis of the stationary shaft 124 to the central axis of the joint 128 is increased to a distance *e*, the desired tilting or tipping of the coil frame 119 about the transverse shaft 122 occurs when the coil frame 119 swings in the direction of the arrow 125. This tilting or tipping of the coil frame 119 is effected with increasing coil fullness in direction toward the larger-diameter end of the conical winding drum 117. Thereby, the circumferential velocity of the textile coil 120 is increased with increasing coil fullness. This increase in the circumferential or peripheral velocity is greater than would be necessary to compensate for or equalize the decreasing thread tension. A consequence thereof is that the lever 139 of the thread-tension sensor 137 is deflected from the neutral or rest position thereof shown in FIG. 7 in direction of the arrow 163. The one-arm lever 142 can now swing out freely in direction of the arrow 164 and thereby unlocks through the rod 143, the previously blocked bellcrank lever 146. At the next-succeeding revolution of the eccentric shaft 162, the two-arm lever 149 is rotated in direction of the arrow 155 by the lever 158 through the compression spring 157, the pull rod 156, the lever end 147 and the actuating rod 148. Accordingly, the pawl 152 engages in a gap between respective teeth of the ratchet wheel 130 and turns the ratchet wheel counterclockwise by one tooth or division. When the lever 149 swings back, the pawl 133 has moved into the next-following tooth gap and has locked the ratchet wheel 130 in a new position thereof by a positive force applied from an external source such as a non-illustrated spring or by its own balance weight or by any other suitable means.

Figure 7:
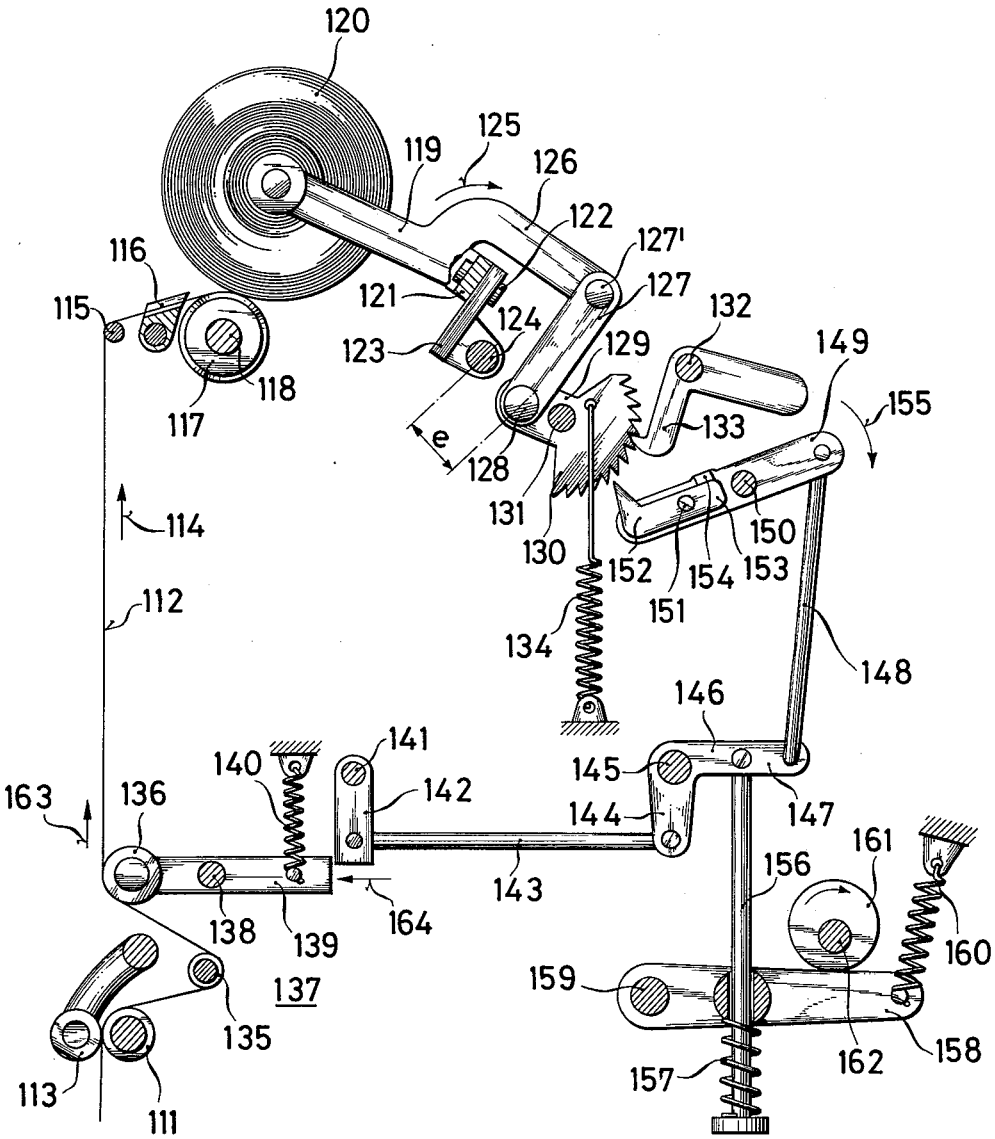
FIG. 7 is a view similar to those of FIGS. 1, 5 and 6 of yet a further embodiment of the apparatus according to the invention.

The rotation of the ratchet wheel 130 counterclockwise by one tooth division, has the consequence that the strap 127 is pulled down to the left-hand side of FIG. 7, so that the coil frame 119 is tilted or tipped back somewhat from the previous position thereof in direction toward the smaller-diameter end of the conical winding drum 117, the thread tension then becoming normalized either immediately or after repetition of the switching or intermittent advancing operation of the ratchet wheel 130. Control is therefore performed by the tension sensor 137, cam 161 and their action of the wheel 130, thus forming control means in this embodiment.

As soon as the normalization of the thread tension has occurred, the two-arm lever 139 of the thread tension sensor 137 resumes the position thereof shown in FIG. 7, and the bellcrank lever 146 is blocked again, because the lever 142 can no longer swing out in the direction of the arrow 164. In the embodiment of the invention according to FIG. 7, the change in the peripheral velocity of the textile coil does not occur continuously, but in individual steps or stages. Therefore, a simplified mechanical construction of the control and a mechanical locking of the adjustment of the coil frame between the individual control steps are advantageously realized so that oscillations and control deterioration or "hunting" cannot occur.

The embodiment according to FIG. 7 may be modified so that the strap 127 is constructed as a spring element, the winding drum 117 is provided with a cylindrical shape, and a screw connecting the members 121 and 123 firmly to one another, is used instead of the joint pin 122. With increasing coil fullness, the spring action of the strap 127 then becomes effective and causes an increasing torque acting in direction opposing the direction of motion of the coil frame 119. The contact pressure of the textile coil 120 with increasing coil fullness is thereby increased which has, as a consequence, a reduction in the slippage and therefore, an increase in the peripheral velocity of the textile coil 120 and, thereby, effects an increase in the thread tension. Moreover, the apparatus and the operation thereof are not changed.

Also, the embodiment according to FIG. 5 can be modified so that the link 64 is constructed as a spring element, the winding drum 47 is given a cylindrical shape, and a rigid clamping device is provided instead of the transverse shaft 52. Upon rotation of the frame 49 in direction of the arrow 62, the spring action of the link 64 then becomes effective and produces an increasing torque opposite in direction to the direction of motion of the coil frame 49. This increases the contact pressure of the textile coil 50 upon the winding drum 47 with increasing coil fullness, whereby the slippage between the winding drum 47 and the textile coil 50 is reduced, resulting in compensation or equalization of the decreasing thread tension.

As noted hereinbefore, the invention is not limited to the illustrated and described embodiments, other embodiments being contemplated within the scope of the claims. Individual elements of the apparatus according to the invention can also advantageously assume dual functions. The rollers 95 and 135 for deflecting the thread, for example, may be constructed as parts of a thread storage device for compensating or equalizing the feed demand for the thread of the textile coil, that demand being non-uniform during each individual stroke of the thread guide 76, 116. The pawl 133 may be connected with a device for stopping the winding operation when the predetermined coil fullness is reached. The eccentric shaft 162 may serve to drive such a stopping device.

There are claimed:

1. Method of controlling or regulating tension in a thread being wound on a textile coil rolling on a winding roller of a thread winding device, at least one of the winding roller and the textile coil being of conical construction, which comprises tipping one of the winding roller and the textile coil relative to the other so as to increase the compressive force of the textile coil on the winding roller toward one of the two ends of the line of contact therebetween whereby the peripheral speed of the textile coil is varied by varying the transmission ratio between the rotary speed of the winding roller and the rotary speed of the textile coil to an extent greater than the variation in the transmission ratio therebetween resulting from the increasing fullness of the winding on the coil.

2. Method according to claim 1 wherein the extent to which the one of the winding roller and the textile coil is tipped relative to the other is dependent upon the parameter, fullness of coil winding as measured by the coil diameter.

3. Method according to claim 1 wherein the variation in the peripheral speed of the textile coil is dependent upon the measured thread tension, and which comprises continuously sensing the thread tension, and increasing the contact pressure between the textile coil and the winding roller at the one end of the line of contact therebetween in accordance with the sensed variation in the thread tension.

4. Method of controlling or regulating tension in a thread being wound on a textile coil rolling on a winding roller of a thread winding device, at least one of the winding roller and the textile coil being of conical construction, which comprises tipping one of the winding roller and the textile coil relative to the other so as to increase the compressive force of the textile coil on the winding roller toward one of the two ends of the line of contact therebetween, whereby the peripheral speed of the textile coil is varied by varying the transmission ratio between the rotary speed of the winding roller and the rotary speed of the textile coil to an extent greater than the variation in the transmission ratio therebetween resulting from the increasing fullness of the winding on the coil, the extent to which the one of the winding roller and the textile coil is tipped relative to the other being dependent upon the parameter, fullness of coil winding as measured by the coil diameter, the tipping of the one of the winding roller and the textile coil relative to the other being to an extent different from that required by the value of the respective parameter, so that the actual thread tension continuously resulting therefrom is correspondingly different from the value thereof that would result from the extent of tipping of the one of the winding roller and the textile coil relative to the other required by the value of the respective parameter, and controllingly readjusting only in one direction of successive values thereof the thus differing thread tension to a nominal value thereof in accordance with the actual thread tension value.

5. Device for controlling or regulating tension in a thread being wound on a textile coil comprising coil frame means for holding a textile coil, a rotatable winding roller contactable with the textile coil for applying frictional pressure thereto so as to revolve the textile coil and wind a thread thereon, pressure-varying means associated with at least one of said winding roller and said coil frame means for continuously varying the contact pressure between the textile coil and said winding roller, and means for determining the fullness of the coil as a measure of the diameter thereof, said coil-fullness determining means being operatively associated with said pressure-varying means for controlling the same in accordance with the fullness of the coil, said coil frame means for holding the textile coil being tippable about an axis transverse to the longitudinal axis of the coil core so as to vary the pressure at the ends of the coil.

6. Device according to claim 5 including control means responsive to the fullness of the coil, as measured by the coil diameter, for tipping the axis of at least one of said coil frame means and said textile coil, said control means comprising a kinematic four-bar linkage.

7. Device according to claim 5 including control means responsive to the fullness of the coil, as measured by the coil diameter, for tipping the axis of at least one of said coil frame means and said textile coil, said control means being manually adjustable for varying the extent of tipping of the respective axis.

8. Device according to claim 5 including control means responsive to the fullness of the coil, as measured by the coil diameter, for tipping the axis of at least one of said coil frame means and said textile coil, said control means being adapted to tip the axis of the coil core in response to the fullness of the coil as measured by the coil diameter, said control means being equipped for controlling the thread tension in only one direction of successive values.

9. Device according to claim 8 wherein said one given direction is that of an increase in the thread tension.

10. Device according to claim 5 including control means responsive to the fullness of the coil, as measured by the coil diameter, for tipping the axis of at least one of said coil frame means and said textile coil and means operatively associated with the textile coil and said coil frame means for sensing the thread tension and for tipping the axis of the coil core in accordance with the thread tension.

11. Device according to claim 10 wherein said last-mentioned means for tipping the axis of the coil core is equipped so as to control the thread tension only in a one given direction of successive values.

12. Device according to claim 11 wherein said given direction is that of a reduction in the thread tension.

13. Device according to claim 5 wherein the surface of said winding roller is formed with a substantially ring-shaped zone having a heightened frictional value with respect to that of the remainder of the surface of said winding roller.

14. Device according to claim 13 wherein the textile coil is substantially cylindrical and said winding roller is substantially conical, said zone of heightened frictional value being located toward the smaller-diameter end of said substantially conical winding roller.

* * * * *